US008657730B2

(12) United States Patent
Manzella et al.

(10) Patent No.: US 8,657,730 B2
(45) Date of Patent: Feb. 25, 2014

(54) UMBILICUS FOR USE IN AN UMBILICUS-DRIVEN FLUID PROCESSING SYSTEM

(71) Applicant: Fenwal, Inc., Lake Zurich, IL (US)

(72) Inventors: Salvatore Manzella, Barrington, IL (US); Richard L. West, Lake Villa, IL (US); Mark B. Jones, Libertyville, IL (US)

(73) Assignee: Fenwal, Inc., Lake Zurich, IL (US)

( * ) Notice: Subject to any disclaimer, the term of this patent is extended or adjusted under 35 U.S.C. 154(b) by 0 days.

(21) Appl. No.: 13/870,694

(22) Filed: Apr. 25, 2013

(65) Prior Publication Data

US 2013/0248040 A1 Sep. 26, 2013

Related U.S. Application Data

(63) Continuation of application No. 13/557,779, filed on Jul. 25, 2012, now Pat. No. 8,460,165, which is a continuation of application No. 12/815,968, filed on Jun. 15, 2010, now Pat. No. 8,257,239.

(51) Int. Cl.
*B04B 7/00* (2006.01)

(52) U.S. Cl.
USPC ..... 494/18; 138/111

(58) Field of Classification Search
USPC ..... 494/17–18, 21, 45, 83–84; 210/380.1, 210/380.3, 781, 782; 138/111
See application file for complete search history.

(56) References Cited

U.S. PATENT DOCUMENTS

| | | | | | |
|---|---|---|---|---|---|
| 2,832,374 | A | * | 4/1958 | November | 285/123.1 |
| 2,936,791 | A | * | 5/1960 | Farrar | 285/114 |
| 3,747,632 | A | * | 7/1973 | Kok et al. | 137/375 |
| 3,885,735 | A | * | 5/1975 | Westbert | 494/27 |
| 4,018,304 | A | * | 4/1977 | Lolachi et al. | 184/6 |
| 4,056,224 | A | * | 11/1977 | Lolachi | 494/18 |
| 4,108,353 | A | * | 8/1978 | Brown | 494/18 |
| 4,109,852 | A | * | 8/1978 | Brown et al. | 494/18 |
| 4,109,854 | A | * | 8/1978 | Brown | 494/18 |
| 4,109,855 | A | * | 8/1978 | Brown et al. | 494/18 |
| 4,114,802 | A | * | 9/1978 | Brown | 494/18 |
| 4,163,519 | A | * | 8/1979 | Stabile | 494/18 |
| 4,164,318 | A | * | 8/1979 | Boggs | 494/18 |
| 4,194,684 | A | * | 3/1980 | Boggs | 494/18 |
| 4,221,322 | A | * | 9/1980 | Drago et al. | 494/60 |
| 4,230,263 | A | * | 10/1980 | Westberg | 494/45 |
| 4,245,383 | A | * | 1/1981 | Boggs | 29/428 |
| 4,261,507 | A | * | 4/1981 | Baumler | 494/45 |
| 4,372,484 | A | * | 2/1983 | Larsson et al. | 494/14 |
| 4,385,021 | A | * | 5/1983 | Neeley | 264/171.11 |

(Continued)

FOREIGN PATENT DOCUMENTS

| | | | | | |
|---|---|---|---|---|---|
| JP | 01164888 | A | * | 6/1989 | F16L 39/00 |
| WO | WO 2004046601 | A1 | * | 6/2004 | F16L 11/14 |

*Primary Examiner* — Charles E Cooley
(74) *Attorney, Agent, or Firm* — Cook Alex Ltd.

(57) ABSTRACT

An umbilicus is provided for use in an umbilicus-driven fluid processing system. The umbilicus has a pair of anchor portions, at least one fluid-transmitting lumen, and a drive shaft. The fluid-transmitting lumen and drive shaft extend between the anchor portions. The lumen and drive shaft may be comprised of different materials. If multiple lumen are provided, they may either be separate from each other and the drive shaft or defined in a single umbilicus body which also provides a lumen for receiving at least a portion of the drive shaft.

18 Claims, 6 Drawing Sheets

(56) References Cited

U.S. PATENT DOCUMENTS

| | | | | | |
|---|---|---|---|---|---|
| 4,389,206 | A | * | 6/1983 | Bacehowski et al. | 494/42 |
| 4,389,207 | A | * | 6/1983 | Bacehowski et al. | 494/42 |
| 4,425,112 | A | * | 1/1984 | Ito | 494/18 |
| 4,439,178 | A | * | 3/1984 | Mulzet | 494/85 |
| 4,459,169 | A | * | 7/1984 | Bacehowski et al. | 156/221 |
| 4,636,193 | A | * | 1/1987 | Cullis | 494/45 |
| 4,710,161 | A | * | 12/1987 | Takabayashi et al. | 494/84 |
| 4,778,444 | A | * | 10/1988 | Westberg et al. | 494/56 |
| 4,865,081 | A | * | 9/1989 | Neumann et al. | 138/111 |
| 4,950,401 | A | * | 8/1990 | Unger et al. | 210/360.1 |
| 5,360,542 | A | * | 11/1994 | Williamson et al. | 210/232 |
| 5,362,291 | A | * | 11/1994 | Williamson, IV | 494/18 |
| 5,449,022 | A | * | 9/1995 | Witthaus et al. | 138/137 |
| 5,501,840 | A | * | 3/1996 | Mantovani et al. | 494/18 |
| 5,514,069 | A | * | 5/1996 | Brown et al. | 494/18 |
| 5,551,942 | A | * | 9/1996 | Brown et al. | 494/45 |
| 5,704,887 | A | * | 1/1998 | Slowik et al. | 494/12 |
| 5,989,177 | A | * | 11/1999 | West et al. | 494/46 |
| 5,996,634 | A | * | 12/1999 | Dennehey et al. | 138/109 |
| 6,267,537 | B1 | * | 7/2001 | Breivik et al. | 405/171 |
| 6,344,020 | B1 | * | 2/2002 | Reitz et al. | 494/46 |
| 6,419,073 | B1 | * | 7/2002 | Piron | 198/370.03 |
| 6,800,054 | B2 | * | 10/2004 | Westberg et al. | 494/43 |
| 6,832,981 | B2 | * | 12/2004 | Witthaus et al. | 494/18 |
| 6,979,776 | B1 | * | 12/2005 | Zimmermann | 174/520 |
| 7,001,321 | B1 | * | 2/2006 | Brown et al. | 494/18 |
| 7,008,366 | B1 | * | 3/2006 | Aitkenhead et al. | 494/18 |
| 7,452,323 | B2 | * | 11/2008 | Aitkenhead et al. | 494/45 |
| 7,849,885 | B2 | * | 12/2010 | Olsen et al. | 138/115 |
| 8,216,120 | B2 | * | 7/2012 | Aitkenhead et al. | 494/45 |
| 8,257,239 | B2 | * | 9/2012 | Manzella et al. | 494/18 |
| 8,277,369 | B2 | * | 10/2012 | West et al. | 494/18 |
| 8,460,165 | B2 | * | 6/2013 | Manzella et al. | 494/18 |
| 2002/0195154 | A1 | * | 12/2002 | Witthaus et al. | 138/111 |
| 2006/0111229 | A1 | * | 5/2006 | Aitkenhead et al. | 494/83 |
| 2009/0239730 | A1 | * | 9/2009 | Aitkenhead et al. | 494/18 |
| 2010/0261596 | A1 | * | 10/2010 | Schimmelpfennig et al. | 494/37 |
| 2011/0303316 | A1 | * | 12/2011 | Manzella et al. | 138/106 |
| 2011/0306913 | A1 | * | 12/2011 | West et al. | 604/5.01 |
| 2013/0248040 | A1 | * | 9/2013 | Manzella et al. | 138/106 |

* cited by examiner

UMBILICUS FOR USE IN AN UMBILICUS-DRIVEN FLUID PROCESSING SYSTEM

CROSS REFERENCE TO RELATED APPLICATIONS

This is a continuation of U.S. patent application Ser. No. 13/557,779, filed on Jul. 25, 2012 and issued as U.S. Pat. No. 8,460,165, which is a continuation of U.S. patent application Ser. No. 12/815,968, filed Jun. 15, 2010 and issued as U.S. Pat. No. 8,257,239, which are both hereby incorporated herein by reference.

BACKGROUND

1. Field of the Disclosure

The present subject matter relates to an umbilicus for use in a fluid processing system.

2. Description of Related Art

Whole blood is routinely separated into its various components, such as red blood cells, platelets, and plasma. In typical blood processing systems, whole blood is drawn from a donor, the particular blood component or constituent is removed and collected, and the remaining blood constituents are returned to the donor. By thus removing only particular constituents, less time is needed for the donor's body to return to normal, and donations can be made at more frequent intervals than when whole blood is collected. This increases the overall supply of blood constituents, such as plasma and platelets, made available for health care.

Whole blood is typically separated into its constituents through centrifugation. This requires that the whole blood be passed through a centrifuge after it is withdrawn from, and before it is returned to, the donor. To avoid contamination, the blood is usually contained within a sealed, sterile system during the entire centrifugation process. Typical blood processing systems thus include a permanent, reusable centrifuge assembly or "hardware" that spins and pumps the blood, and a disposable, sealed and sterile fluid processing or fluid circuit assembly that actually makes contact with the donor's blood. The centrifuge assembly engages and spins a portion of the fluid processing assembly (often called the centrifuge or separation chamber) during a collection procedure. The blood, however, makes actual contact only with the fluid processing assembly, which is used only once and then discarded.

To avoid the need for rotating seals, and to preserve the sterile and sealed integrity of the fluid processing assembly, blood processing systems often utilize centrifuges that operate on the "one-omega, two-omega" operating principle. This principle is disclosed in detail in U.S. Pat. No. 4,120,449 to Brown et al., which is hereby incorporated by reference, and enables centrifuges to spin a sealed, closed system without the need for rotating seals and without twisting the components of the system. Blood processing systems that make use of the principle typically include a fluid processing assembly that includes a plastic bag or molded chamber that is spun in the centrifuge and that is connected to the blood donor and to a stationary portion of the centrifuge assembly through an elongated member that may be made up of one or more plastic tubes. The elongated member is commonly referred to as an "umbilicus" and is typically arranged in a question mark (or upside-down question mark) configuration with both of its end portions coaxially aligned with the axis of rotation of the centrifuge. The centrifuge chamber is rotated at "two-omega" RPM and the umbilicus is orbited around the centrifuge chamber at "one-omega" RPM. In other words, one end of the umbilicus is stationary, the other end rotates at a two-omega speed with the centrifuge chamber to which it is attached, and the intermediate portion or midsection of the umbilicus orbits about the chamber at a one-omega speed. The effect is that the end of the umbilicus, which is opposite the bag or chamber and is connected to the donor via plastic tubing, does not twist up as the bag is spun. The sealed, sterile integrity of the fluid processing assembly is thus maintained without the need for rotating seals.

U.S. Pat. No. 5,996,634 to Dennehey et al., which is hereby incorporated herein by reference, discloses one such blood processing apparatus based on the "one-omega, two-omega" operating principle. In this apparatus, a disposable fluid processing assembly having an umbilicus and a processing chamber is mountable within a centrifuge assembly. One "fixed" end of the umbilicus is held rotationally stationary substantially over the axis of centrifugation. The other "free" end of the umbilicus joins the processing chamber and is free to rotate with the processing chamber around the axis of centrifugation. The mid-portion of the umbilicus is supported by a wing plate that orbits the mid-portion of the umbilicus around the axis of centrifugation at the one-omega speed. On account of having one "fixed" end and one "free" end, the umbilicus will "twist" about its own central axis as its mid-portion orbits around the processing chamber. The action of the umbilicus naturally "untwisting" itself will cause its "free" end (and, hence, the associated processing chamber) to spin at the average prescribed two-omega speed. This arrangement eliminates the need for complex gearing or belting arrangements to create a one-omega, two-omega drive relationship that was common in prior art devices. The umbilicus itself drives the processing chamber at a two-omega speed.

A typical umbilicus comprises a unitarily formed (generally by an extrusion process) main body defining a plurality of fluid-transmitting lumen. The body is formed of a material specially selected to perform the several required functions of the umbilicus, including being flexible enough to assume the proper orientation with regard to the centrifuge assembly, rigid enough to serve as a drive mechanism for rotating the processing chamber, and having a torsional stiffness leading to the aforementioned "untwisting" at the proper two-omega speed during fluid processing. A known material used in forming the umbilicus is the polyester elastomer material sold by E.I. DuPont de Nemours & Company under the trademark Hytrel®. While such a unitarily formed umbilicus has proven suitable, there can be difficulties in securing the umbilicus to the remainder of the disposable fluid processing assembly because of material differences or incompatibility. For example, it is common to employ polyvinyl chloride ("PVC") tubing to connect at least one end of the umbilicus to other elements of the associated disposable fluid processing assembly. Thus, a PVC-to-Hytrel® material solvent bond is required to associate the umbilicus and the tubing. Additionally, an umbilicus comprised of Hytrel® material may be relatively expensive to manufacture. Accordingly, the need remains for a relatively low-cost improved umbilicus.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, an umbilicus is provided for use in a centrifugal fluid processing system, with the umbilicus comprising a first anchor portion and a second anchor portion. The umbilicus further includes at least one elongated, flexible fluid-transmitting portion comprised of at least a first material and defining a lumen extending between the first and second anchor portions for transmitting a fluid between the first and second anchor portions. The umbilicus also includes at least one flexible, non-fluid-transmitting shaft comprised of at least a second material different than the first material and extending between the first and second anchor portions.

In another aspect, an umbilicus is provided for use in an umbilicus-driven fluid processing system, with the umbilicus comprising a first anchor portion and a second anchor portion. The umbilicus further includes an elongated, flexible, non-fluid-transmitting drive shaft and an elongated umbilicus body extending between the first and second anchor portions. The umbilicus body defines a plurality of lumen, with one of the lumen receiving at least a portion of the drive shaft and at least one of the lumen being adapted for transmitting a fluid between the first and second anchor portions.

In yet another aspect, an umbilicus is provided for use in an umbilicus-driven centrifugal fluid processing system, with the umbilicus comprising a first anchor portion and a second anchor portion. The umbilicus further includes an elongated, flexible, non-fluid-transmitting drive shaft and a plurality of elongated hollow tubes extending between the first and second anchor portions.

DESCRIPTION OF THE ILLUSTRATED EMBODIMENTS

The embodiments disclosed herein are for the purpose of providing the required description of the present subject matter. They are only exemplary, and may be embodied in various forms and in various combinations. Therefore, specific details disclosed herein are not to be interpreted as limiting the subject matter as defined in the accompanying claims.

Figure 1:
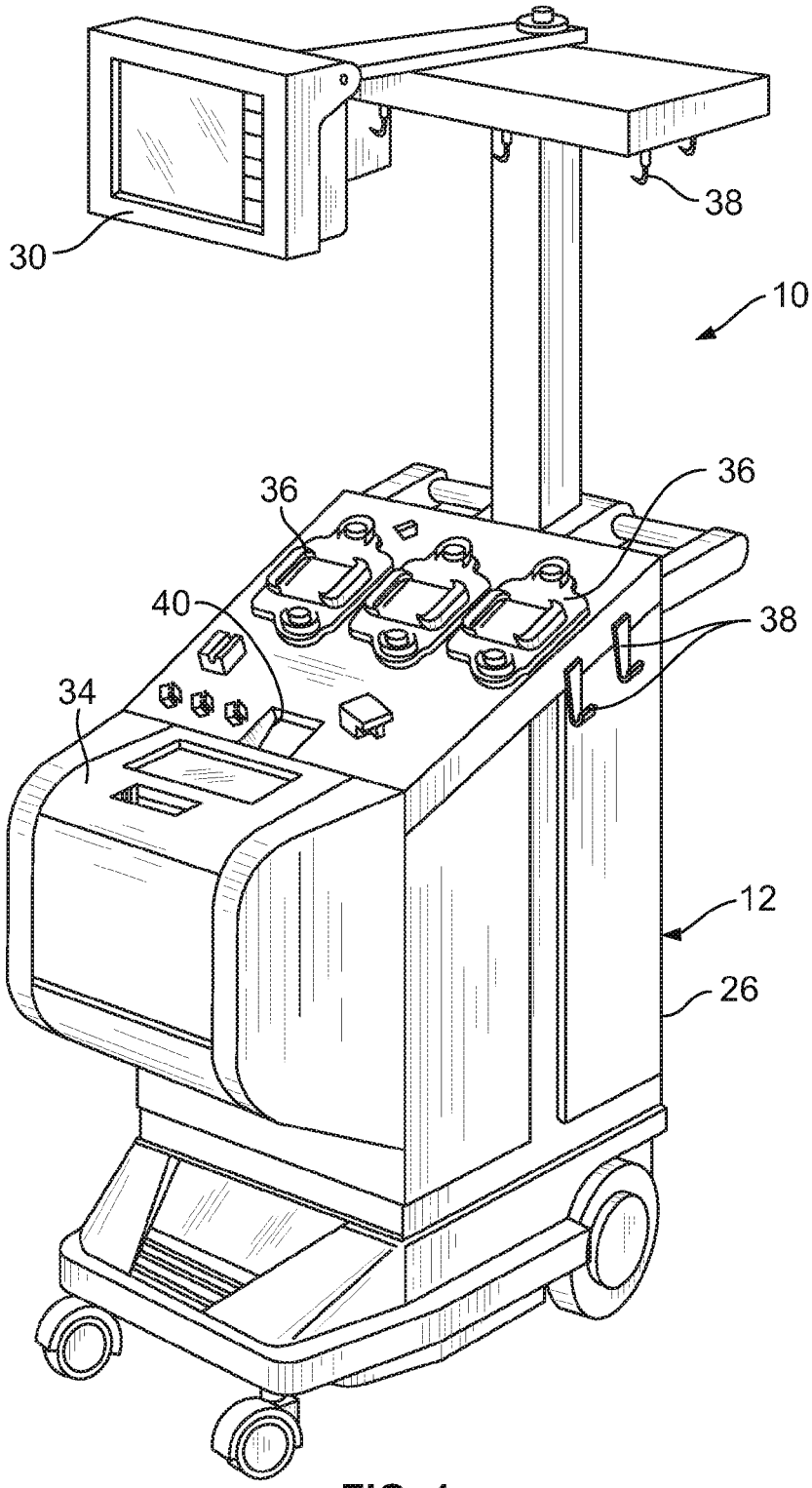
FIG. 1 (Prior Art)
FIG. 1 is a perspective view of an exemplary durable fluid processing system that may be used in combination with bearing assemblies according to the present disclosure.

FIG. 1 shows a centrifugal fluid processing system 10 that may be used in combination with an umbilicus according to the present disclosure. The system is currently marketed as the AMICUS® separator by Fenwal, Inc. of Lake Zurich, Ill. The system 10 can be used for processing various fluids, but is particularly well suited for processing whole blood, blood components, or other suspensions of biological cellular materials. The system 10 includes a centrifuge assembly 12 for separating a fluid into its constituent parts. A more detailed description of the centrifuge assembly 12 and the other elements of the system 10 can be found in U.S. Pat. No. 5,996,634, which is incorporated by reference herein.

Figure 2:
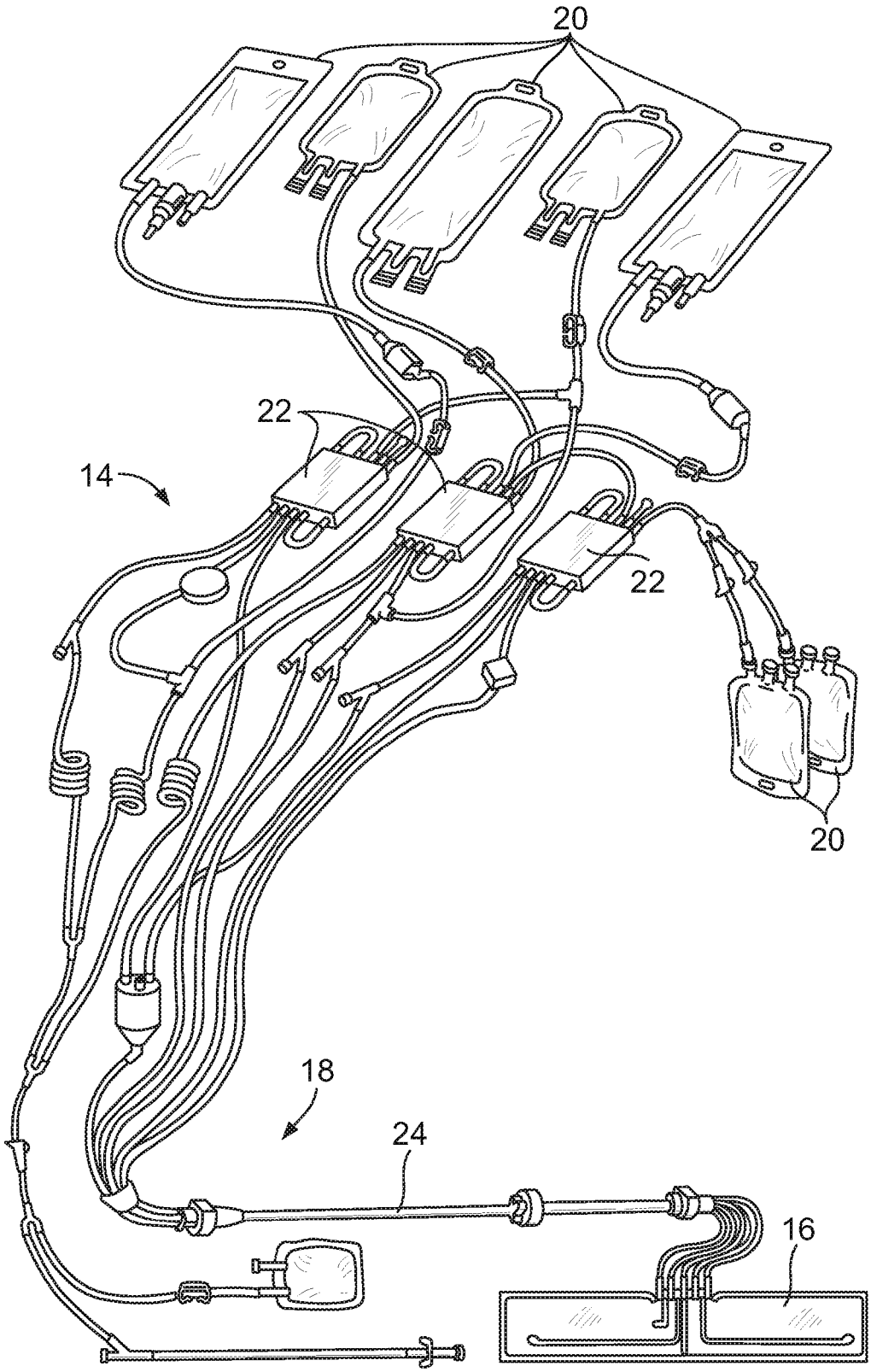
FIG. 2 (Prior Art)
FIG. 2 is a perspective view of a disposable fluid processing assembly usable in association with the durable fluid processing system of FIG. 1.
Figure 3:
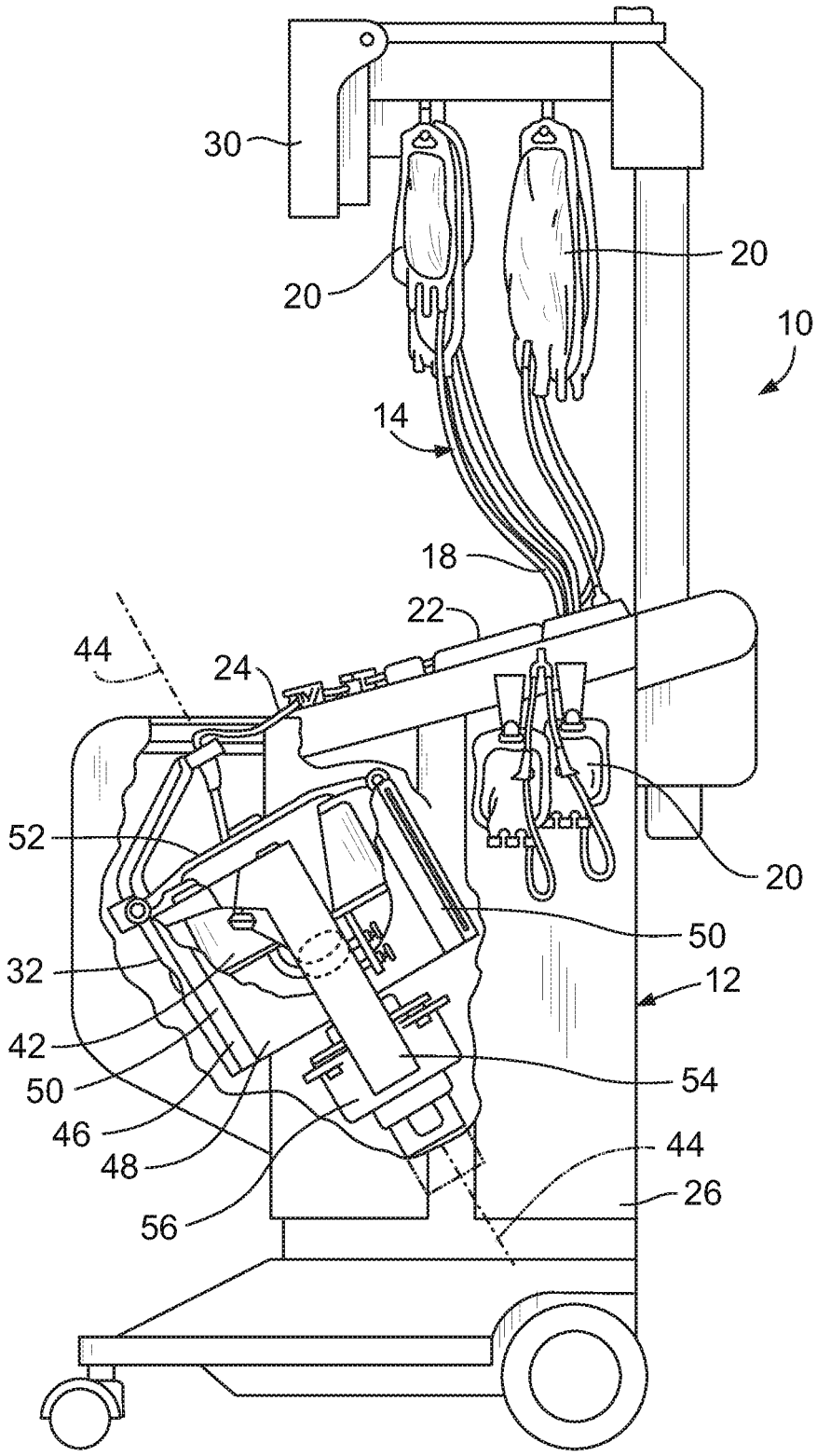
FIG. 3 (Prior Art)
FIG. 3 is a side elevational view of the disposable fluid processing assembly of FIG. 2 mounted on the durable fluid processing system of FIG. 1, which is partially broken away.

The durable fluid processing system 10 is used in combination with a disposable processing set or fluid circuit 14, an example of which is shown in FIG. 2. FIG. 3 shows the disposable set 14 mounted on the durable system 10. The disposable set 14 is a preferably single use, disposable item loaded on the system 10 at the time of use. After a fluid processing procedure has been completed, the operator preferably removes the disposable set 14 from the system 10 and discards it.

Figure 5:
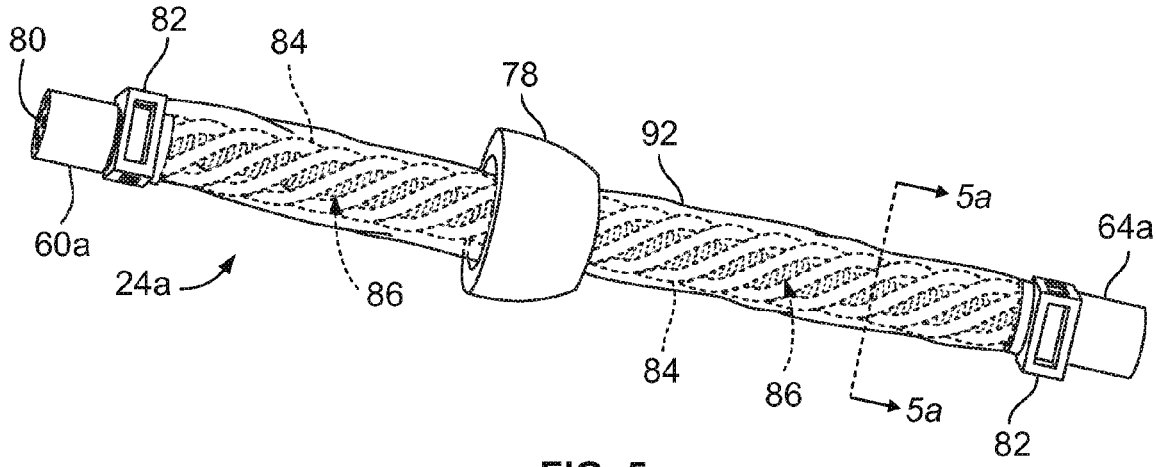
FIG. 5 is a perspective view of an umbilicus according to one aspect of the present disclosure.
Figure 6:
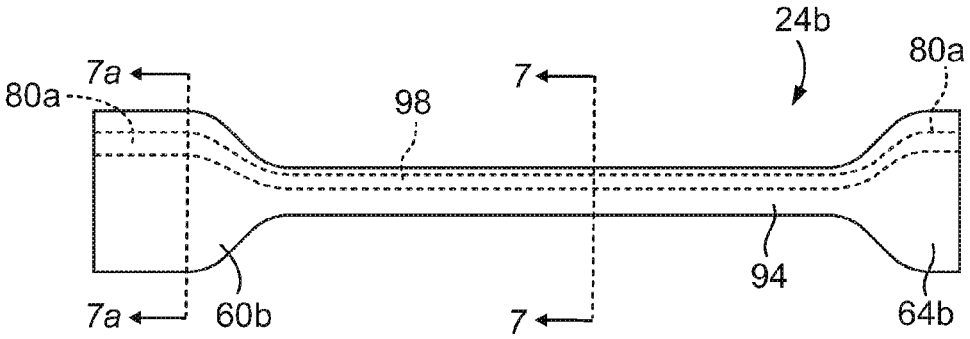
FIG. 6 is an elevational view of another embodiment of an umbilicus according to the present disclosure.
Figure 7:
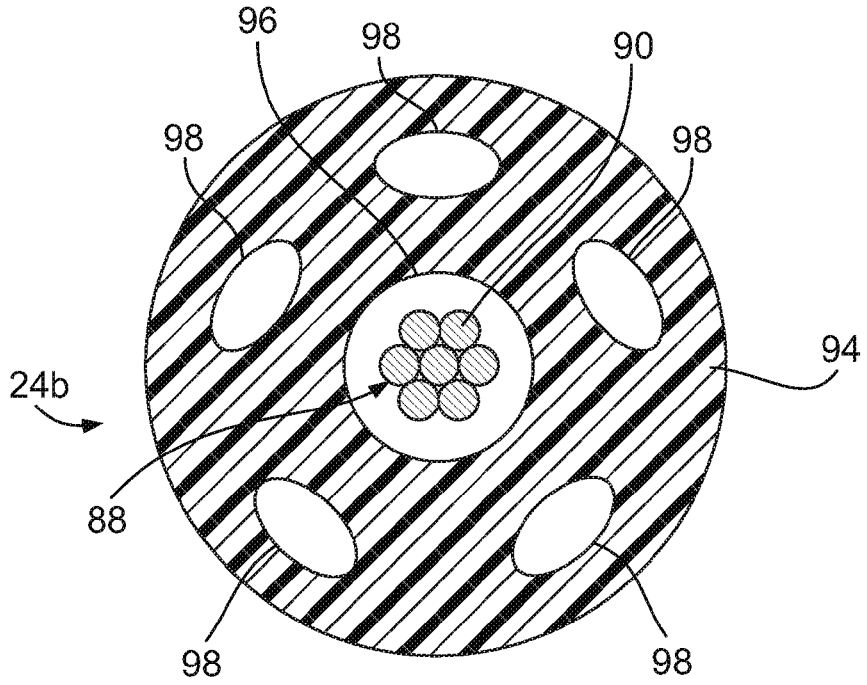
FIG. 7 is a cross-sectional view of the umbilicus of FIG. 6, taken through the line 7-7 of FIG. 6.

The disposable set 14 includes a processing chamber 16 (FIG. 2). In use, the centrifuge assembly 12 rotates the processing chamber 16 to centrifugally separate blood components. Whole blood is conveyed to the processing chamber 16, and separated blood components are conveyed from the processing chamber 16, through a plurality of flexible tubes that form part of a fluid circuit 18. The fluid circuit 18 further includes a plurality of containers 20 that may be supported by elevated hangers located over the centrifuge assembly 12 (see FIG. 3) and that dispense and receive liquids during processing. Fluid flow through the fluid circuit 14 may be controlled in a variety of ways. Preferably, fluid flow is controlled via cassettes 22 with pre-formed fluid passageways, which may be selectively opened and closed pneumatically, hydraulically, or by movable actuators. The number of cassettes may vary, but in the illustrated embodiment, there are three cassettes 22, which operate in association with valve and pump stations on the centrifuge assembly 12 to direct liquid flow among multiple liquid sources and destinations during a blood processing procedure. Tubes connected to the processing chamber 16 lead to a flexible umbilicus 24, with additional tubes at the other end of the umbilicus 24 fluidly connecting the processing chamber 16 (via the umbilicus 24) to the remainder of the disposable set 14, including the containers 20 and the cassettes 22. The umbilicus 24 is shown generically in FIGS. 2-4 and particular embodiments of an umbilicus according to the present disclosure are shown in FIGS. 5-7 and will be described in greater detail herein. Advantageously, the disposable set 14 is a pre-assembled closed system, assuring an operator that it is a sterile unit.

As illustrated, the centrifuge assembly 12 includes a wheeled cabinet 26 that can be easily rolled from place to place. A user actuable processing controller 30 is provided which enables the operator to control various aspects of the blood processing procedure. A centrifuge rotor assembly 32 is provided behind a fold open door 34 that can be pulled open at the front of the cabinet 26 (FIG. 3). A plurality of valve and pump stations 36 (FIG. 1) are provided on the top face of the cabinet for receiving and controlling the various cassettes 22. A plurality of hooks or hangers 38 are provided on the cabinet 26 for suspending the various containers 20.

Figure 4:
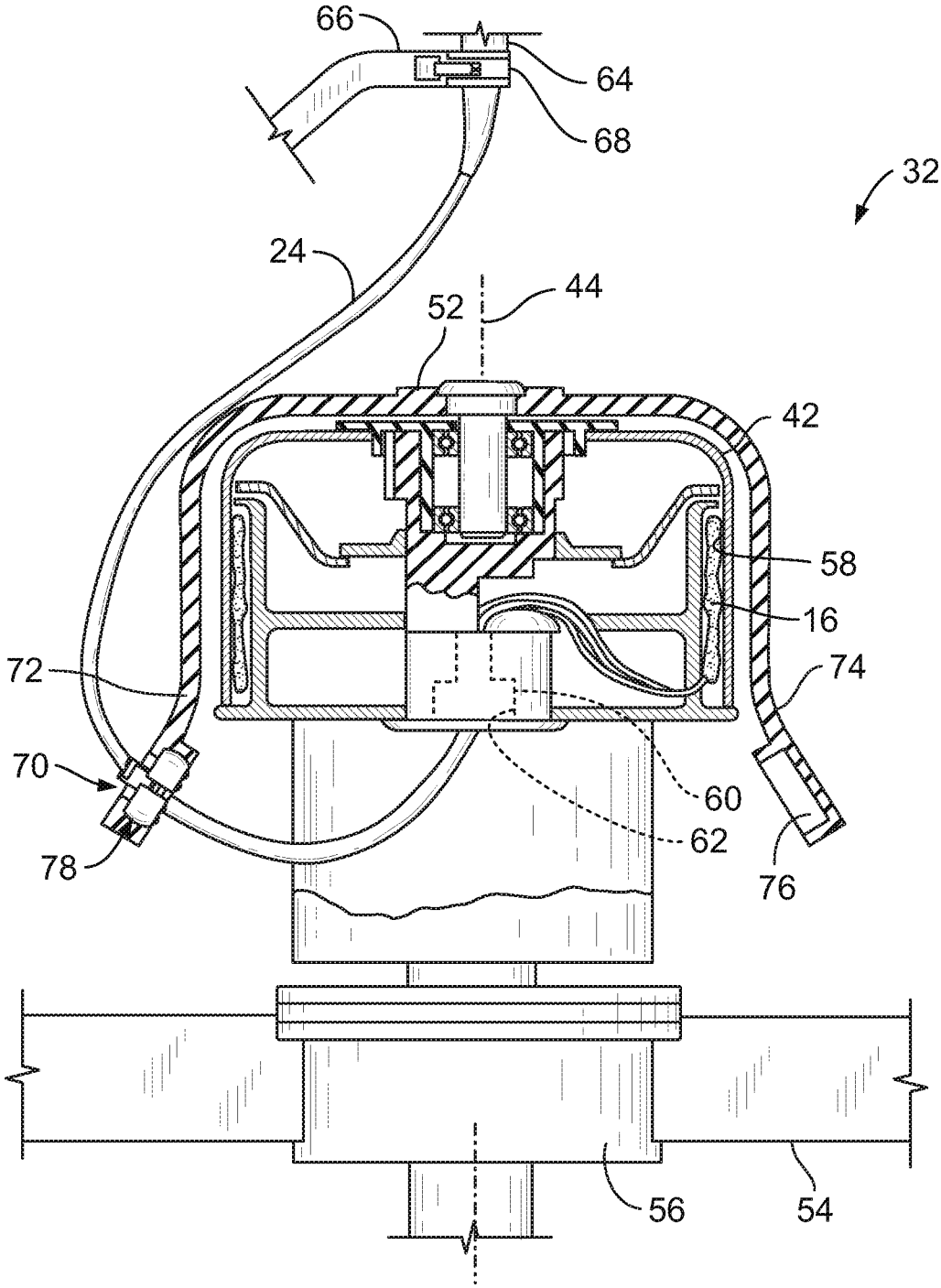
FIG. 4 (Prior Art)
FIG. 4 is a side detail view of a centrifuge included in the durable fluid processing system of FIG. 1, showing the centrifuge in combination with an umbilicus of the disposable fluid processing assembly.

In use, the fold open door 34 is opened and the processing chamber 16 of the disposable set 14 is mounted in the centrifuge rotor assembly 32 (FIG. 4). The umbilicus 24 is threaded through the centrifuge rotor assembly 32 and out through an opening 40 in the upper panel of the cabinet 26 (FIG. 3). The cassettes 22 are snapped into respective ones of the valve and pump stations 36 and the containers 20 are hung from the appropriate hangers 38 (FIG. 3). After appropriate connections are made to the donor using known intravenous techniques, the operator enters appropriate commands on the processing controller 30 to begin the processing procedure.

Looking more closely at the centrifuge rotor assembly 32 (FIG. 4), it includes a chamber assembly 42 that is supported for rotation around an axis of centrifugation 44. The centrifuge further includes a centrifuge yoke assembly 46 that includes a yoke base 48, a pair of upstanding yoke arms 50, and a yoke cross member 52 mounted between the arms 50. The yoke base 48 is rotatably supported on a stationary platform 54 that carries the rotating mass of the centrifuge rotor assembly 32. The yoke base 48 is also supported for rotation around the axis of centrifugation independently of the chamber assembly 42. An electric drive 56 rotates the yoke assembly 46 relative to the stationary platform 54 around the axis of centrifugation 44. The chamber assembly 42 is free to rotate around the axis of centrifugation 44 at a rotational speed that is different from the rotational speed of the yoke assembly 46.

Referring further to FIG. 4, the chamber assembly 42 defines an annular chamber 58, centered around the axis of centrifugation 44, for receiving the processing chamber 16 of the disposable set 14. The umbilicus 24 extends through the lower center of the chamber assembly 42 in alignment with the axis of centrifugation 44. A first anchor portion or support block 60 of the umbilicus 24 is received in a lowermost umbilicus mount 62 located at the lower center of the chamber assembly 42. The first anchor portion 60 and umbilicus mount 62 function to transfer torque between the umbilicus 24 and chamber assembly 42 so that the chamber assembly 42 rotates around the axis of centrifugation in response to twisting of the umbilicus 24 around its axis.

The other end of the umbilicus 24 is defined by a second anchor portion or support block 64 that is removably received in an upper umbilicus mount 66 positioned over the centrifuge chamber assembly 42 substantially in alignment with the axis of centrifugation 44. An over-center clamp 68 at the end of the upper umbilicus mount 66 clamps onto the second anchor portion 64 to hold the adjacent segment of the umbilicus 24 rotationally stationary and in collinear alignment with the axis of centrifugation 44.

As further illustrated in FIG. 4, the portion of the umbilicus 24 between the second anchor portion 64 and the first anchor portion 60 is supported by a middle umbilicus mount or bearing support 70 that is carried at the lower end of a wing plate 72 extending outwardly and downwardly from the yoke cross member 52. As the electric drive 56 rotates the centrifuge yoke assembly 46 (FIG. 3) around the axis of centrifugation 44, the wing plate 72 and the bearing support 70 pull the midsection of the umbilicus 24 around the axis of centrifugation 44 as well. As the umbilicus 24 orbits around the axis 44, at rotational speed one-omega, a twisting action is imparted to the umbilicus 24 around its own axis. The midsection of the umbilicus 24 is free to rotate around its own axis relative to the wing plate 72 as the yoke assembly 46 is turned, so it will tend to "untwist" against the twisting motion imparted by the rotating yoke assembly 46. As it untwists in this manner, the umbilicus 24 spins the centrifuge chamber assembly 42 around the axis of centrifugation 44 at an average rotational speed of two-omega.

To maintain balance as the yoke assembly 46 turns, an additional wing plate 74 extends from the yoke cross member 52 diametrically opposite the wing plate 72. A counterweight 76 sufficient to balance the mass of the bearing support 70 and umbilicus 24 is carried on the lower end of the additional wing plate 74.

To reduce the risk of damage to the umbilicus 24 during fluid processing, an umbilicus bearing assembly 78 may surround it and be received within the bearing support 70, in a manner well known to those skilled in the art. An exemplary umbilicus bearing assembly is described in U.S. Pat. No. 5,989,177 to West et al., which is hereby incorporated herein by reference.

FIG. 5 shows one embodiment of an umbilicus suitable for use in the system 10, with the umbilicus being generally identified with the reference number 24*a*. The umbilicus 24*a* preferably comprises and consolidates the multiple fluid paths leading to and from the processing chamber 16, although it may also have only a single flow path. In the illustrated blood processing application, it provides a continuous, sterile environment for fluids (such as blood and blood components) to pass. In construction, the umbilicus 24*a* is flexible enough to function in the relatively small, compact operating space the centrifuge assembly 12 provides. Still, the umbilicus 24*a* is durable enough to withstand the significant flexing and torsional stresses imposed by the small, compact spinning environment, where continuous rotation rates of several thousand revolutions per minute are typically encountered for periods of up to two or three hours.

In the illustrated embodiment, the umbilicus 24*a* includes molded first and second anchor portions 60*a* and 64*a* defining at least one and preferably a plurality of flow paths or fluid passages 80. In the illustrated embodiment, each anchor portion 60*a*, 64*a* defines five fluid passages 80, which is equal to the number of flow paths, which can be separate tubes or a single tube with multiple lumen or a combination of tubes with single and/or multiple lumen connecting the processing chamber 16 to the remainder of the disposable set 14 (as best illustrated in FIG. 2). Each fluid passage 80 of the first anchor portion 60*a* is associated with one of the tubes or lumen leading into the processing chamber 16, while each fluid passage 80 of the second anchor portion 64*a* is associated with one of the tubes or lumen leading to the remainder of the disposable set 14. Accordingly, the number of fluid passages 80 defined in each anchor portion 60*a*, 64*a* may vary according to the number of tubes or lumen leading from the umbilicus 24*a* to the processing chamber 16 and the remainder of the disposable set 14.

As for the outer surface of the anchor portions 60*a* and 64*a*, it may be substantially the same as known anchor portions, which may be advantageous to allow an umbilicus of the present disclosure to be readily used with prior art centrifuge assemblies without requiring any significant other modification. More particularly, each anchor portion 60*a*, 64*a* may include an integral, molded flange 82 to ensure a non-uniform outer surface, which is useful in dictating a certain orientation when the umbilicus 24*a* is installed in the centrifuge assembly. In the illustrated embodiment, each flange 82 is generally D-shaped, although other configurations may also be employed without departing from the scope of the present disclosure.

In one embodiment, the anchor portions 60*a* and 64*a* are made from the same material as the tubes, typically PVC. By making the anchor portions 60*a* and 64*a* from PVC instead of a material such as Hytrel®, the material cost of the umbilicus 24*a* is reduced and it becomes easier to reliably associate the umbilicus 24*a* (via the anchor portions 60*a* and 64*a*) to the tubes, because a PVC-to-PVC bond is employed instead of a Hytrel®-to-PVC solvent bond.

Figure 5A:
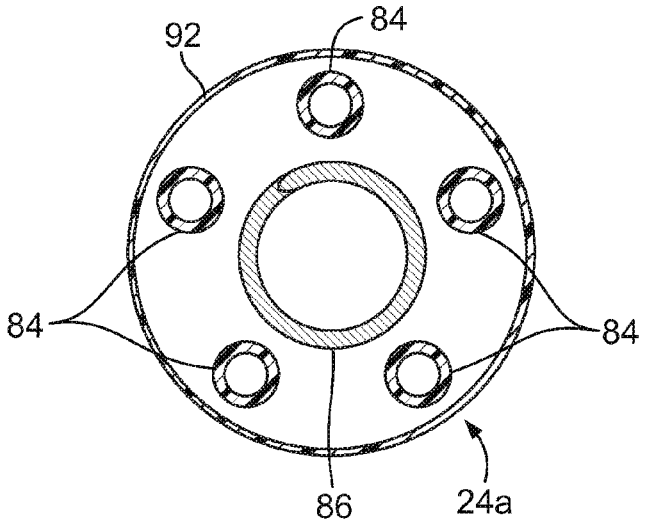
FIG. 5*a* is a cross-sectional view of the umbilicus of FIG. 5, taken through the line 5*a*-5*a* of FIG. 5.

Extending between the anchor portions 60*a* and 64*a* are a plurality of fluid-transmitting lumen or tubes 84 and a non-fluid-transmitting drive shaft 86 (FIG. 5*a*). As illustrated, all of these are provided separately from each other (in contrast to a typical umbilicus, which is a single molded piece that defines all of the fluid flow lumen and omits a separate drive shaft). The tubes 84 are elongated, each having one end terminating in a fluid passage 80 of the first anchor portion 60*a* and an opposite end terminating in a fluid passage 80 of the second anchor portion 64*a*. By such an arrangement, each tube 84 serves to place one of the fluid passages 80 of the first anchor portion 60*a* in fluid communication with one of the fluid passages 80 of the second anchor portion 64*a*. In the illustrated embodiment, each anchor portion 60*a*, 64*a* has five fluid passages 80, so five tubes 84 may be provided to establish fluid communication between each of the fluid passages 80 of the first anchor portion 60*a* and an associated fluid passage 80 of the second anchor portion 64*a*. It may be advantageous for the tubes 84 to be made from a flexible polymeric material to allow them to assume the "upside-down question mark" configuration illustrated in FIG. 4. In one embodiment, the tubes 84 are made from the same material as the anchor portions 60*a* and 64*a* (PVC in an exemplary embodiment) to make it easier to reliably secure the tubes 84 to the anchor portions 60*a* and 64*a*.

The drive shaft 86 has one end terminating at the first anchor portion 60*a* and an opposite end terminating at the second anchor portion 64*a*. The drive shaft 86, in contrast to the hollow tubes 84, has no fluid passageway therealong and is not suited for transmitting fluid, but instead serves to deliver the necessary torque to drive and rotate the centrifuge chamber assembly 42, as described above. The drive shaft 86 may be configured in a number of ways, including as a monofilament or as a combination of multiple filaments. A monofilament drive shaft 86 is shown in FIG. 5, while a multi-filament drive shaft 88 is shown in FIG. 7. While the umbilicus 24*a* of FIG. 5 is shown with a monofilament drive shaft 86 and an alternative umbilicus 24*b* of FIGS. 6 and 7 (which will be described in greater detail below) is shown with a multi-filament drive shaft 88, it should be understood that either type of drive shaft may be used with either umbilicus embodiment.

The monofilament drive shaft 86 of FIG. 5 is comprised of a single cylindrical filament or wire which is preferably, but not necessarily, spiral-wound into a coil shape. In the illustrated embodiment, the monofilament drive shaft 86 is coiled in one direction (i.e., either clockwise or counterclockwise) and has outer and inner diameters which are substantially uniform along the length of the drive shaft 86. In other embodiments, the filament may be wound in different directions along its length and/or have varying outer and/or inner diameters.

As described previously, the midsection of the umbilicus 24*a* (which includes the drive shaft 86) is free to rotate around its own central axis during fluid processing. Accordingly, during this rotational movement the coils of the drive shaft 86 will either tighten as the umbilicus 24*a* "twists" and then untighten (returning to or at least approaching an equilibrium condition) as the umbilicus 24*a* "untwists" or untighten as the umbilicus 24*a* "twists" and then tighten (returning to or at least approaching an equilibrium condition) as the umbilicus 24*a* "untwists," depending on the direction in which the filament is coiled. Typically, the umbilicus 24*a* will only be orbited in one direction and will twist in one direction during use, in which case it may be advantageous to provide a coiled drive shaft 86 which only moves away from an equilibrium condition by tightening rather than one which only moves away from an equilibrium condition by untightening. Such a configuration may be advantageous to increase the durability of the drive shaft 86, as a coil in an especially untightened or unwound condition may be more likely to suffer from plastic (i.e., irreversible) deformation than a coil in a tightened condition.

As for the multi-filament drive shaft 88 of FIG. 7, it is comprised of a plurality of cylindrical filaments or wires 90 which are braided or interwoven or otherwise joined together to effectively form a cable (similar to an aircraft cable or braided rope in exemplary embodiments). In the illustrated embodiment, the multi-filament drive shaft 88 is comprised of seven braided filaments 90, although the number of filaments may vary without departing from the scope of the present disclosure.

With regard to the constitution of the drive shaft, it may vary, but it may be advantageous for the drive shaft to be flexible (so as to assume the "upside down question mark" shape of FIG. 4), yet with sufficient strength so as to deliver the necessary torque to drive and rotate the centrifuge chamber assembly 42. To that end, it may be advantageous for the drive shaft to be comprised of a different material than the tubes 84. In one embodiment, the tubes 84 are comprised of PVC while the drive shaft is comprised of a metal, such as stainless steel. In another embodiment, the tubes 84 are comprised of PVC while the drive shaft is comprised of a polymer, such as nylon. When employing a multi-filament drive shaft 88, a metallic material may be advantageous due to the nature in which the various filaments 90 are joined together, while either a metallic or polymeric material may be suitable when employing a monofilament drive shaft 86. The drive shaft may be comprised of other materials (such as polymer and metal combinations) or a combination of materials without departing from the scope of the present disclosure.

In one embodiment, the ends of the drive shaft 86 are associated with the anchor portions 60*a* and 64*a* at or adjacent to the center of anchor portions 60*a* and 64*a*, making the drive shaft 86 generally coaxial with the anchor portions 60*a* and 64*a*. In such an embodiment, the fluid passages 80 of the anchor portions 60*a* and 64*a* are spaced away from the center of the associated anchor portion 60*a*, 64*a*, for example in a ring pattern which encircles the center of the associated anchor portion 60*a*, 64*a*. With the fluid passages 80 so arranged, it will be seen (as shown in FIG. 5) that the tubes 84 (when they and the drive shaft 86 are connected to the anchor portions 60*a* and 64*a*) will generally encircle and surround the drive shaft 86. The tubes 84 may be helically spiraled or coiled or wound or otherwise wrapped around the drive shaft 86 (as shown in FIG. 5), which reduces the risk of kinking in the tubes 84. The drive shaft 86 also may be treated with a coating to reduce the risk of abrasion to the adjacent tubes 84. For example, the drive shaft 86 may be coated with a low friction material such as polytetrafluoroethylene or (in the case of a metallic drive shaft 86) nylon.

In turn, the tubes 84 which surround the drive shaft 86 may themselves be surrounded by a cover or sheath 92. In the embodiment of FIG. 5, the sheath 92 is a flexible sleeve of material surrounding all or a portion of the tubes 84 and extending at least partially (but more advantageously all of the way) between the anchor portions 60*a* and 64*a*. A sheath 92 may be advantageous for several reasons, such as maintaining the tubes 84 close to the drive shaft 86 (thereby avoiding any risk of a tube 84 becoming snagged upon anything during fluid processing) and preventing abrasions to the tubes 84 during fluid processing.

Figure 7A:
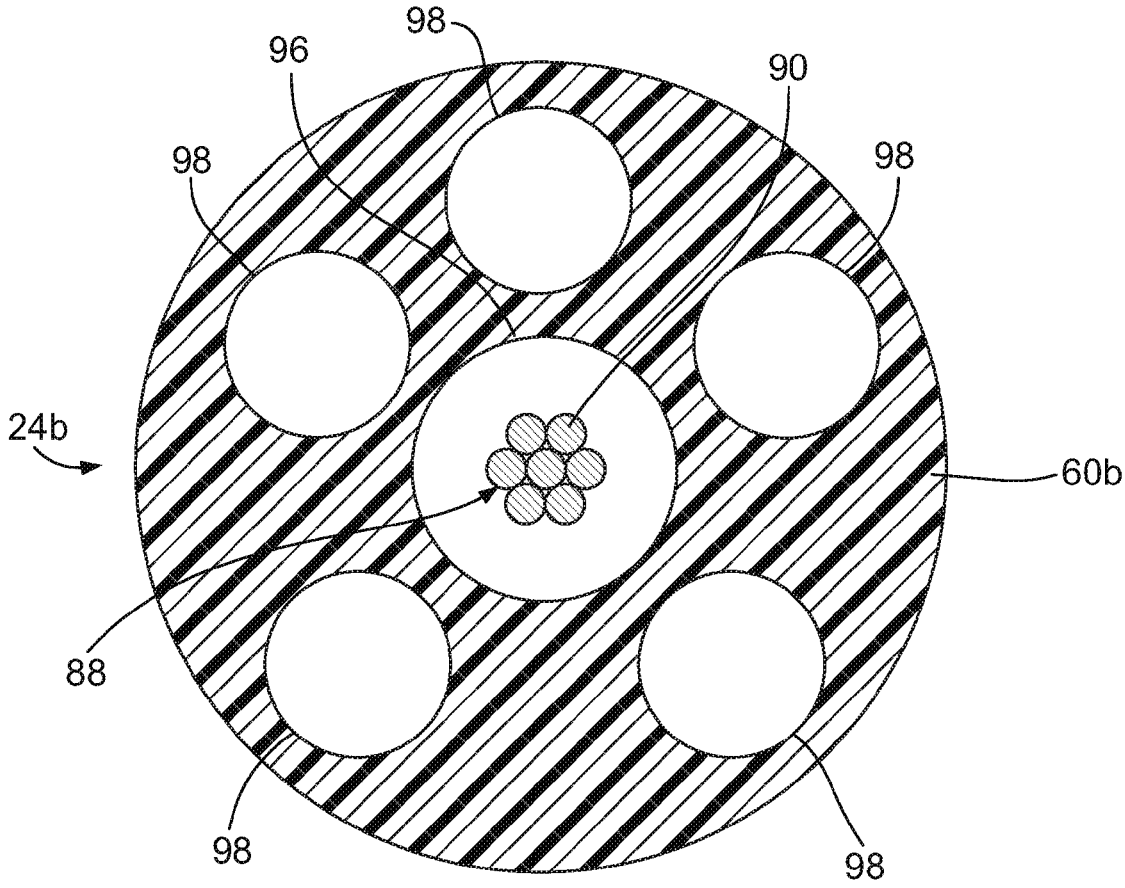
FIG. 7*a* is a cross-sectional view of the umbilicus of FIG. 6, taken through the line 7*a*-7*a* of FIG. 6.

In an alternative embodiment, illustrated in FIGS. 6-7*a*, the umbilicus 24*b* comprises a drive shaft 88 and an umbilicus body 94. FIG. 7 shows a multi-filament drive shaft 88, but a monofilament drive shaft 86 (as shown in FIG. 5) may also be employed without departing from the scope of the present disclosure.

The umbilicus body 94 defines a plurality of integral lumen, with one of the lumen 96 receiving at least a portion of the drive shaft 88 and at least one of the other lumen 98 (and most advantageously all of the other lumen 98) being adapted for transmitting a fluid between the first and second anchor portions 60*b* and 64*b* of the umbilicus 24*b*. As FIGS. 7 and 7*a* show, the lumen 96 which receives the drive shaft 88 may have a substantially circular cross-section, while the fluid-transmitting lumen 98 may have substantially elliptical or oblong cross-sections, if desired, or be circular. An elliptical shape may provide flow capacity without enlarging the outer diameter of the umbilicus body 94.

The fluid-transmitting lumen 98 function to place the anchor portions 60*b* and 64*b* in fluid communication with each other, so the arrangement of the fluid-transmitting lumen 98 is dependent upon the location of the fluid passages 80*a* of the anchor portions 60*b* and 64*b*. In the illustrated embodiment, the drive shaft-receiving lumen 96 is substantially aligned with the central axis of the umbilicus body 94, with the fluid-transmitting lumen 98 being symmetrically positioned around the central axis to line up with the fluid passages 80*a* of the anchor portions 60*b* and 64*b*. By such an arrangement, each fluid-transmitting lumen 98 serves to place one of the fluid passages 80*a* of the first anchor portion 60*b* in fluid communication with one of the fluid passages 80*a* of the second anchor portion 64*b*. In the illustrated embodiment, each anchor portion 60*b*, 64*b* has five fluid passages 80*a*, so five fluid-transmitting lumen 98 may be provided to establish fluid communication between each of the fluid passages 80*a* of the first anchor portion 60*b* and an associated fluid passage 80*a* of the second anchor portion 64*b*.

In the illustrated embodiment, the first and second anchor portions 60*b* and 64*b* are integrally formed with the remainder of the umbilicus body 94, rather than being separately provided. The anchor portions 60*b* and 64*b* of FIG. 6 are enlarged ends of the umbilicus body 94 which are shown generically, but it will be understood that they may be variously configured (e.g., to match the shape of the anchor portions shown in FIG. 4 or 5) and otherwise serve the same function as the anchor portions previously described. In the embodiment shown in FIG. 6, the fluid-transmitting lumen 98 transitions smoothly to the associated fluid passages 80*a* of the anchor portions 60*b* and 64*b*, with the inner diameter of the fluid-transmitting lumen 98 increasing in the vicinity of the anchor portions 60*b* and 64*b* to a maximum inner diameter at the fluid passages 80*a* (compare FIGS. 7 and 7*a*). Such a configuration may be advantageous, as the fluid passages 80*a* are adapted to be associated with tubing of the disposable set 14, which typically has a larger inner diameter than what may be desirable for the fluid-transmitting lumen 98.

In one embodiment, the umbilicus body 94 is comprised of PVC, in which case it is advantageous for the anchor portions 60*b* and 64*b* (whether provided separately or integrally formed with the umbilicus body 94) to also be made of PVC. By making the umbilicus body 94 and anchor portions 60*b* and 64*b* from PVC instead of a material such as Hytrel®, the material cost of the umbilicus 24*b* is reduced and it becomes easier to reliably associate the umbilicus 24*b* (via the anchor portions 60*b* and 64*b*) to the tubes of the disposable set 14, because a PVC-to-PVC bond is employed instead of a Hytrel®-to-PVC solvent bond. Similar to the embodiment of FIG. 5, the fluid-transmitting lumen 98 are comprised of a different material than the drive shaft 88.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the gasket member alone, the gasket member in combination with the hardware or cassette, and/or the gasket member in combination with the hardware and cassette.

The invention claimed is:

1. An umbilicus for use in an umbilicus-driven fluid processing system, comprising:

an elongated, single-piece umbilicus body having enlarged ends and defining a plurality of lumen; and an elongated, flexible, non-fluid-transmitting drive shaft extending between the enlarged ends of the umbilicus body, wherein one of said lumen receives at least a portion of the drive shaft, at least one other of said lumen is a fluid-transmitting lumen adapted for transmitting a fluid between the enlarged ends of the umbilicus body, and the fluid-transmitting lumen has a different cross-sectional shape at the enlarged ends of the umbilicus body and at a position between the enlarged ends.

2. The umbilicus of claim 1, wherein the drive shaft comprises a single filament.

3. The umbilicus of claim 1, wherein the drive shaft comprises a plurality of filaments.

4. The umbilicus of claim 1, wherein the fluid-transmitting lumen has a larger cross-sectional area at the enlarged ends of the umbilicus body than therebetween.

5. The umbilicus of claim 4, wherein the fluid-transmitting lumen has a minimum diameter at a position between the enlarged ends of the umbilicus body and a maximum diameter at the enlarged ends, and defines a tapered transition between the minimum diameter and the maximum diameter.

6. The umbilicus of claim 1, wherein the lumen receiving the drive shaft is substantially coaxial with a central axis of the umbilicus body.

7. The umbilicus of claim 6, wherein said at least one other of said lumen define a plurality of fluid-transmitting lumen.

8. The umbilicus of claim 7, wherein said plurality of fluid-transmitting lumen are symmetrically positioned around the central axis of the umbilicus body.

9. The umbilicus of claim 1, wherein the fluid-transmitting lumen has a generally oblong cross-sectional shape at a position between the enlarged ends of the umbilicus body.

10. The umbilicus of claim 9, wherein the fluid-transmitting lumen has a generally circular cross-sectional shape at the enlarged ends of the umbilicus body.

11. The umbilicus of claim 1, wherein the fluid-transmitting lumen has a generally elliptical cross-sectional shape at a position between the enlarged ends of the umbilicus body.

12. The umbilicus of claim 1, wherein, at a position between the enlarged ends of the umbilicus body, the umbilicus body and the non-fluid-transmitting lumen have substantially circular cross-sectional shapes and the fluid-transmitting lumen has a generally oblong cross-sectional shape.

13. An umbilicus for use in an umbilicus-driven fluid processing system, comprising:

an elongated, single-piece umbilicus body having enlarged ends and defining a plurality of lumen; and an elongated, flexible, non-fluid-transmitting drive shaft extending between the enlarged ends of the umbilicus body, wherein one of said lumen receives at least a portion of the drive shaft, at least one other of said lumen is a fluid-transmitting lumen adapted for transmitting a fluid between the enlarged ends of the umbilicus body, and the outer surface of the umbilicus body defines a tapered transition between the enlarged ends and the portion of the umbilicus body positioned between the enlarged ends.

14. An umbilicus for use in an umbilicus-driven fluid processing system, comprising an elongated, single-piece umbilicus body having enlarged ends and defining a plurality of fluid-transmitting lumen extending between the enlarged ends and adapted for transmitting a fluid between the enlarged ends, wherein the outer surface of the umbilicus body defines tapered transitions between the enlarged ends and the portion of the umbilicus body positioned therebetween, and each fluid-transmitting lumen has a minimum diameter at a position between the tapered transitions and a maximum diameter at the enlarged ends.

15. The umbilicus of claim 14, wherein each fluid-transmitting lumen defines a tapered section between the minimum diameter and the maximum diameter.

16. The umbilicus of claim 15, wherein at least a portion of one of the tapered transitions of the umbilicus body is positioned at the same longitudinal location as at least a portion of one of the tapered sections of the fluid-transmitting lumen.

17. The umbilicus of claim 14, wherein each fluid-transmitting lumen has a generally oblong cross-sectional shape at a position between the enlarged ends of the umbilicus body and a generally circular cross-sectional shape at the enlarged ends.

18. The umbilicus of claim 14, wherein each fluid-transmitting lumen has a generally elliptical cross-sectional shape at a position between the enlarged ends of the umbilicus body and a generally circular cross-sectional shape at the enlarged ends.

* * * * *